US006044648A

United States Patent [19]

Rode

[11] Patent Number: 6,044,648

[45] Date of Patent: Apr. 4, 2000

[54] COOLING DEVICE HAVING LIQUID REFRIGERANT INJECTION RING

[75] Inventor: Donald W. Rode, Marietta, Ohio

[73] Assignee: Forma Scientific, Inc., Marietta, Ohio

[21] Appl. No.: 09/157,286

[22] Filed: Sep. 18, 1998

Related U.S. Application Data

[60] Provisional application No. 60/059,351, Sep. 19, 1997.

[51] Int. Cl.[7] ..... F25D 25/00

[52] U.S. Cl. ..... 62/62; 62/50.2; 62/52.1

[58] Field of Search ..... 62/62, 64, 50.2, 62/52.1

[56] References Cited

U.S. PATENT DOCUMENTS

| | | | |
|---|---|---|---|
| 671,608 | 4/1901 | Ostergreen . | |
| 2,089,428 | 8/1937 | Ross et al. | 62/176 |
| 3,058,317 | 10/1962 | Putman | 62/52 |
| 3,121,999 | 2/1964 | Klasbohm et al. | 62/48 |
| 3,421,336 | 1/1969 | Lichtenberger et al. | 62/45 |
| 3,446,028 | 5/1969 | Wulf | 62/45 |
| 3,464,222 | 9/1969 | Gramse | 62/45 |
| 3,492,831 | 2/1970 | Maurer et al. | 62/62 |
| 3,570,262 | 3/1971 | Gramse | 62/89 |
| 3,638,443 | 2/1972 | Maurer | 62/52 |
| 4,116,017 | 9/1978 | Oberpriller | 62/62 |
| 4,213,501 | 7/1980 | Pfepfer et al. | 62/50.2 |
| 4,327,799 | 5/1982 | Scheiwe et al. | 62/62 |
| 4,726,195 | 2/1988 | Klee | 62/62 |
| 5,388,415 | 2/1995 | Glinka et al. | 62/52.1 |

FOREIGN PATENT DOCUMENTS

| | | | |
|---|---|---|---|
| 1211545 | 2/1986 | U.S.S.R. | 62/62 |

*Primary Examiner*—Ronald Capossela
*Attorney, Agent, or Firm*—Wood, Herron & Evans, L.L.P.

[57] ABSTRACT

A cooling device for rapidly cooling items, such as biological samples. The cooling device includes an enclosure having a chamber and an air circulation path at least partially within the chamber. A fan is operatively connected to the chamber for circulating air within the air circulation path and a perforated tube is disposed within the air circulation path for receiving a liquid refrigerant under pressure and distributing refrigerant in gaseous form to the air circulation path. Preferably the perforated tube is formed as a coil having multiple revolutions and either an axial blade fan or a centrifugal fan is received generally within the coils.

14 Claims, 2 Drawing Sheets

COOLING DEVICE HAVING LIQUID REFRIGERANT INJECTION RING

This application is based on and claims the priority of Provisional Application Ser. No. 60/059,351, filed Sep. 19, 1997. Provisional Application Ser. No. 60/059,351 is hereby fully incorporated by reference herein.

BACKGROUND OF THE INVENTION

The present invention generally relates to cooling devices, such as cooling chambers which utilize directly injected refrigerant to cool various products, such as biological samples.

In the past, a cooling chamber utilizing directly injected liquid nitrogen has been used to cool products such as biological samples. In one relevant prior device, liquid nitrogen is directly injected toward a cooling fan and then dispersed in both liquid and vapor form over the products within the chamber. Other types of liquid refrigerant may be utilized but, typically, liquid nitrogen is used and directly expands during this process into the air coming into contact with the product. Often, the expansion and vaporization of the refrigerant in a confined space, such as a chamber, is incomplete. This results in liquid refrigerant spraying on a portion of the product or products, causing rapid cooling of such portions of the product or products, while other portions of the product which are shielded from the liquid spray are cooled much more slowly. This non-uniform cooling is objectionable from a process standpoint.

To correct problems such as those mentioned above, it would be desirable to provide a rapid cooling device which, for example, more uniformly cools various items such as biological samples. This can ensure that the biological samples are frozen in a more viable state.

SUMMARY OF THE INVENTION

The present invention therefore provides a cooling device generally including an enclosure having a chamber and an air circulation path at least partially within the chamber. A fan is operatively connected to the chamber for circulating air within the air circulation path. In accordance with a general aspect of the invention, a perforated tube is disposed within the air circulation path of the chamber and receives a liquid refrigerant under pressure. Preferably, the tube is formed as a coil having at least one revolution and, more preferably, a plurality of revolutions. The perforations are disposed at least along an inwardly facing surface of the coil and air is circulated through the coil by the fan. In a first embodiment, the fan is an axial blade fan and the coil is disposed generally about the fan. In a second embodiment, the coil is again disposed generally about the fan, however, the fan in this case is a centrifugal fan. In this second embodiment, the perforated tube is preferably formed as multiple, spaced apart coils and the centrifugal fan directs air between the spaced apart coils during the cooling process. It will also be appreciated that the coils in the first embodiment may also be spaced apart.

The present invention improves the uniformity of product cooling by vaporizing most if not all of the liquid refrigerant inside a coil, with the coil being used preferably as a fan shroud. This transfers a large percentage of the product heat to the refrigerant through convection at the tube heat exchanger surface, and by mixing the process air with cold refrigerant vapor. In the present invention, the liquid refrigerant, such as liquid nitrogen, is injected into a coiled, perforated tube of one or more turns which is used as a shroud over the process air fan. The liquid refrigerant is injected at a higher pressure, preferably 22–40 psig, than the process air in the chamber, which is typically at 0 psig or atmospheric pressure. This results in the liquid refrigerant entering the coil with enough velocity to centrifugally force the liquid refrigerant against the outermost portion of the inner wall surface of the coiled tube.

The heat from the process air or, in other words, the air within the chamber, is transferred to the coil by means of the forced convection, resulting from the air movement over the outside surface of the coil which is caused by the process air fan. The liquid refrigerant, which is expanding into the lower pressure of the coil interior, absorbs the heat, (the latent heat of vaporization), by forced convection between the liquid refrigerant and the interior surface of the coil. This cools the coil which, in turn, cools the process air. As the liquid refrigerant expands and absorbs heat, it is converted to cold refrigerant gas vapor. This gas separates from the liquid by virtue of greatly reduced density, and is expelled from the coil through a series of holes or perforations on the inside diameter of the coiled tube. This cold refrigerant gas is mixed with the process air by the process air fan, further cooling the process air (sensible heat of the cold refrigerant gas). The process air, cooled by the above mechanisms, absorbs heat from product (via fan forced convection), thereby uniformly cooling the product within the chamber.

Various objectives, advantages and additional features of the invention will become more readily apparent to those of ordinary skill in the art upon review of the following detailed description of the preferred embodiments taken in conjunction with the accompanying drawings.

DETAILED DESCRIPTION OF THE PREFERRED EMBODIMENTS

Figure 1:
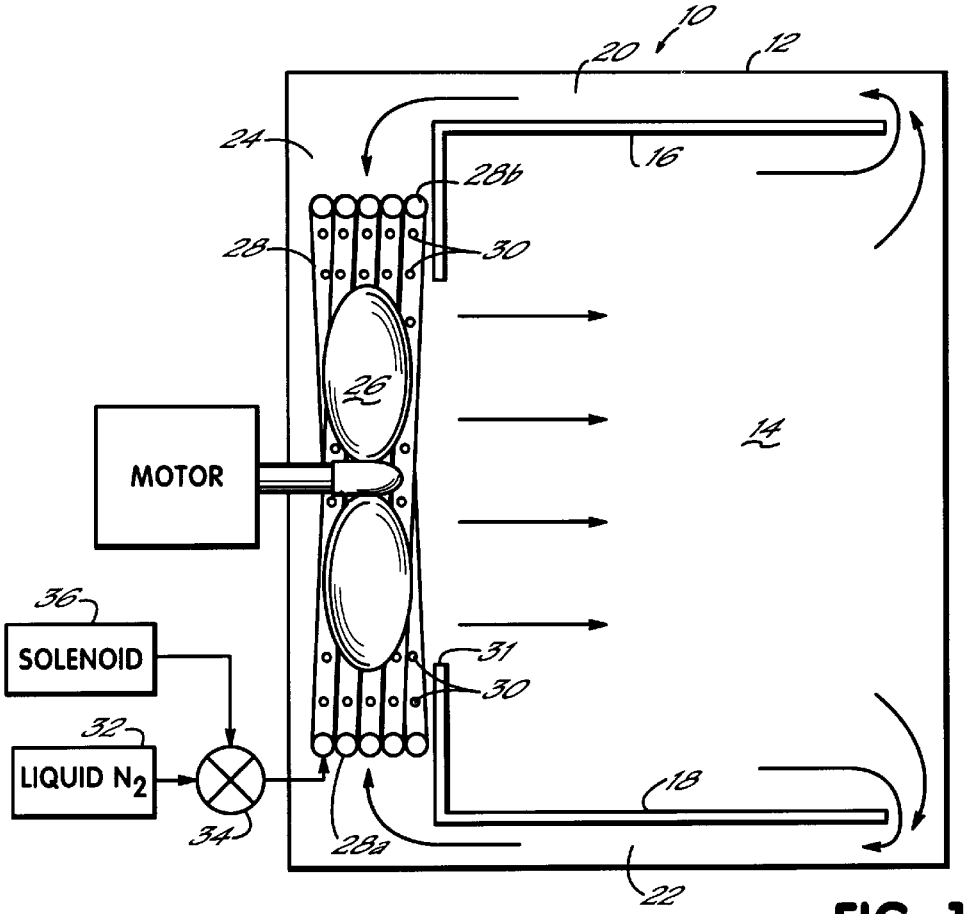
FIG. 1 is a schematic, cross sectional view of a device constituting a first embodiment of the present invention, as generally seen from the front.

Referring to FIG. 1, a cooling device 10 is shown and comprises an enclosure 12 having an interior chamber 14 formed by interior walls 16, 18. Interior walls 16, 18 preferably also form respective upper, lower and side air plenums 20, 22, 24 which, together with chamber 14, form an air circulation path. A fan 26 is disposed within this air circulation path and is connected to a motor, as shown, to move air within chamber 14, plenums 20 and 22, and finally back into plenum 24 in which fan 26 is disposed to complete the air circulation. In accordance with the invention, a tube 28, preferably in the form of a coil having perforations 30, is disposed within the air circulation path. Specifically, coiled tube 28 is disposed within plenum 24 and circularly about fan 26. Coil 28 is further disposed about a hole 31 contained in walls 16, 18 of enclosure 12. As shown, fan 26 is disposed in alignment with this hole 31. A source of liquid refrigerant, such as liquid nitrogen 32 is connected to an open end 28*a* of coil 28, preferably via a valve 34 operated by a solenoid 36. Another end 28*b* of coil 28 is closed. Perforations 30 are preferably about ⅛" in diameter and spaced about 4" apart; however, this may vary according to the application.

Figure 2:
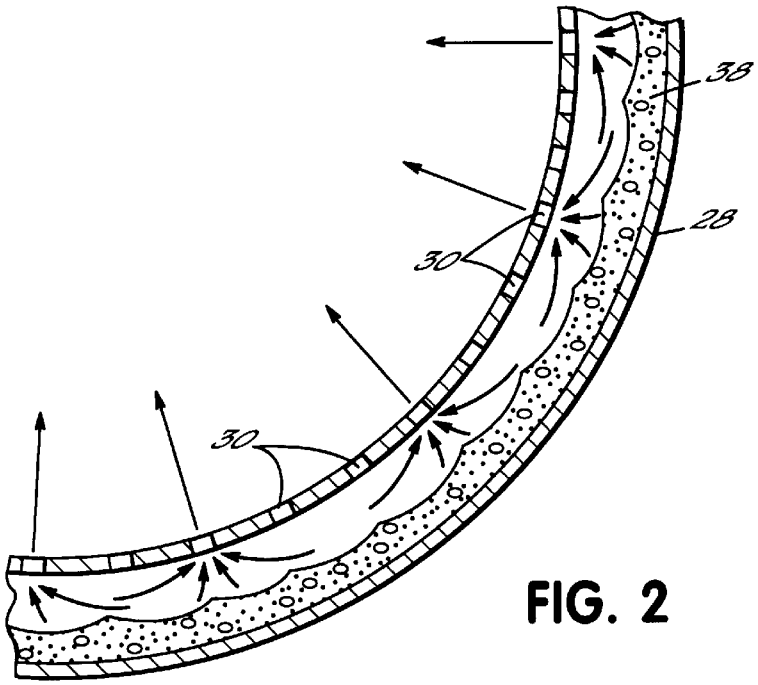
FIG. 2 is an enlarged view of a portion of the coiled tube of the invention.

As further shown in the enlarged view of coil 28 in FIG. 2, the liquid refrigerant 38 and is injected at a pressure of approximately 22–40 psig and ideally flows along an outside portion of tube 28 through centrifugal force. This liquid refrigerant, such as liquid nitrogen, will vaporize as it travels through the coil and the vaporized gas will exit the tube through apertures 30 as shown in FIG. 2. Thus, this cold gas will exit into the air flow created by fan 26 and will uniformly flow into chamber 14 to uniformly cool the product contained therein. Ideally, all of the refrigerant in liquid phase will vaporize through apertures 30 as it travels through coil 28 before reaching closed end 28*b*.

Figure 3:
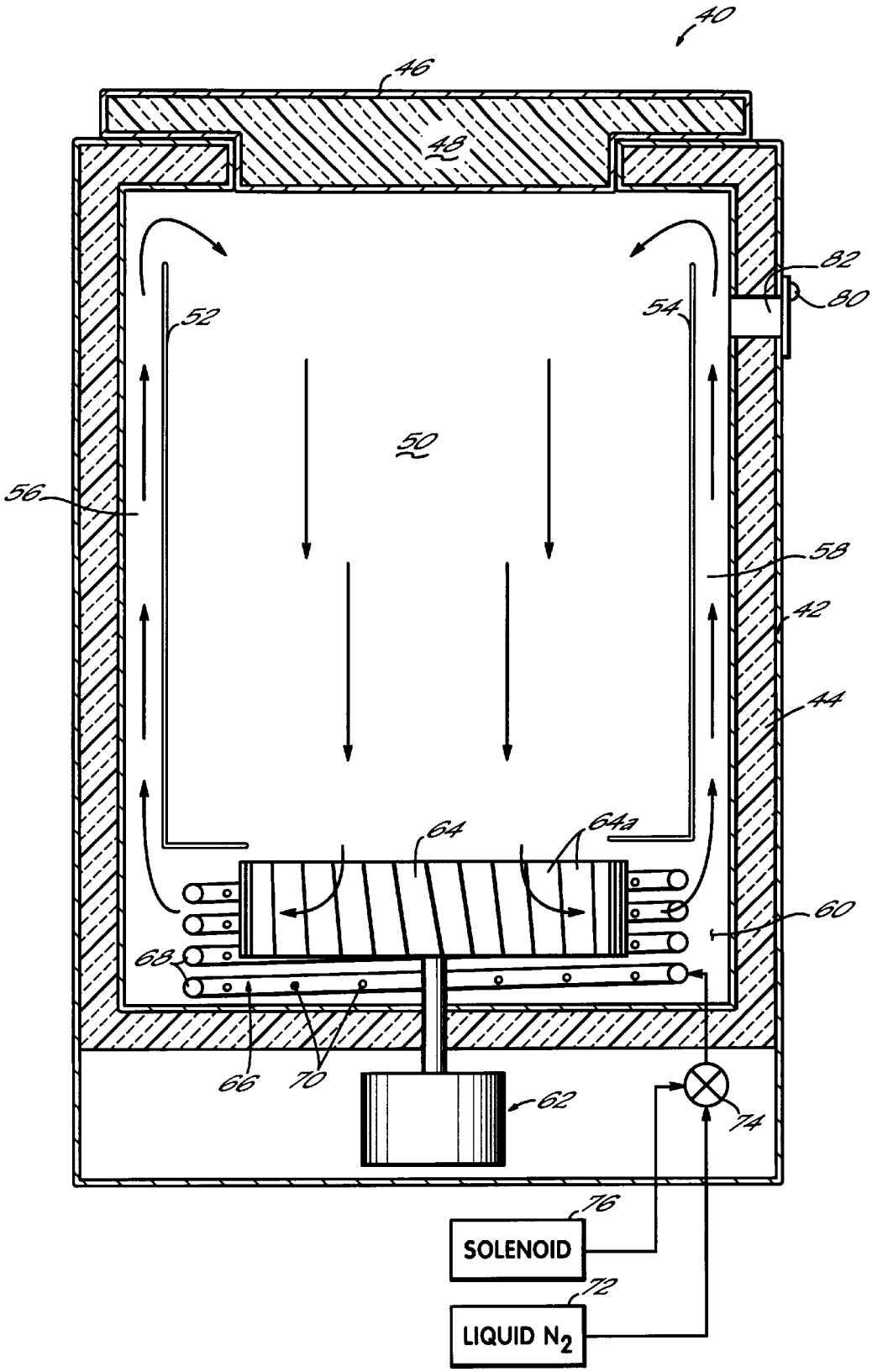
FIG. 3 is a schematic, cross sectional view of a chamber incorporating a second embodiment of the invention.

Referring now to FIG. 3, a cooling device 40 constructed in accordance with a second embodiment of the invention is shown and comprises an enclosure 42 which may include insulation 44 in outer walls thereof as shown. In a conventional manner, the first embodiment will also be insulated although this has not been shown. In this second embodiment, device 40 is shown with a lid 46, also having appropriate insulation material 48, as one means of accessing an interior chamber 50 of device 40. Of course, device 40 may be oriented on its side, as generally shown in FIG. 1, and in this case a conventional front opening door may be used instead. Chamber 50 is generally defined by interior walls 52, 54 which create plenums 56, 58, 60 as in the first embodiment. A motorized fan assembly 62 is mounted within plenum 60 and, in the second embodiment, incorporates a centrifugal fan 64 having a plurality of blades 64*a* which generally direct air radially outward from fan 64 in the direction of the arrows. A perforated tube 66 shaped as a plurality of coils 68 is disposed generally about fan 64. Coils 68 are spaced apart as shown to allow air to flow through coils 68 as it is directed radially outward by fan 64.

Each coil 68 includes perforations 70 as discussed above with reference to FIG. 2. A pressurized liquid nitrogen source 72 and a valve 74 operated, for example, by a solenoid 76 are connected with perforated tube 66 also as discussed above with regard to the first embodiment. A pressure relief valve 80 is preferably connected to enclosure 42 and allows excess pressure to be relieved through aperture 82. Valve 80 may, for example, simply comprise a sheet of Teflon or other material which allows a build-up of pressure to escape from chamber 50, as necessary, but closes under its own resilience when such pressure is not present. This second embodiment operates in the same manner as the first embodiment, except that the direction of air flowing through chamber 50 is opposite. That is, air is drawn into fan 64 and forced radially outward into plenums 56 and 58 before again entering the main part of chamber 50.

While the present invention has been illustrated by a description of various embodiments and while these embodiments has been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method as shown and described. The invention itself should only be defined by the appended claims.

Wherein I claim:

1. A cooling device comprising:

an enclosure including a chamber and an air circulation path at least partially within the chamber;

a fan operatively connected to the chamber for circulating air within the air circulation path; and a tube having an inlet and a plurality of perforations along a lengthwise extent thereof, said tube being disposed within the air circulation path of the chamber for receiving a pressurized liquid refrigerant through the inlet and distributing the refrigerant substantially in gaseous form through the perforations and into the air circulation path.

2. The cooling device of claim 1, wherein the tube is formed as a coil having at least one revolution.

3. The cooling device of claim 2, wherein the coil is disposed generally about the fan and the perforations are positioned along an inwardly facing surface thereof.

4. The device of claim 3, wherein the inlet is connected to a valve for selectively admitting the pressurized liquid refrigerant through the inlet.

5. The device of claim 2, wherein the coil is disposed generally about a portion of the air circulation path and the perforations are positioned along an inwardly facing surface thereof.

6. The device of claim 5, wherein the inlet is located at a first end of the coil and is connected to a valve for selectively admitting the pressurized liquid refrigerant through the inlet.

7. The device of claim 1, wherein the perforated tube further comprises a plurality of coils and the perforations are positioned along inwardly facing surfaces of the coils.

8. The device of claim 7, wherein the coils are spaced apart and the fan further comprises a centrifugal fan disposed within the coils for directing air between the coils.

9. The device of claim 7, wherein the fan further comprises an axial blade fan disposed within the coils.

10. A method of cooling an item in an enclosure using liquid refrigerant capable of changing from a liquid state to a gaseous state, the method comprising:

placing the item in the enclosure, injecting the liquid refrigerant under pressure into a tube having a plurality of perforations, changing the liquid refrigerant into its gaseous state within the tube and allowing gaseous refrigerant to escape through the perforations, and circulating air including the gaseous refrigerant through the enclosure and in contact with the item.

11. The method of claim 10, further comprising:

injecting the liquid refrigerant into a coiled tube.

12. The method of claim 11, further comprising:

circulating air using a fan disposed adjacent to the coiled tube.

13. The method of claim 12, further comprising:

positioning the fan within the coiled tube, and injecting the gaseous refrigerant toward the fan.

14. The method of claim 10, wherein the tube is formed with spaced apart coils and further comprising circulating air between the coils.

* * * * *